US005417188A

United States Patent [19]

Schiattino

[11] Patent Number: 5,417,188

[45] Date of Patent: May 23, 1995

[54] DOUBLE EFFECT DISTRIBUTION SEQUENTIAL VALVE SHAFT ASSEMBLY

[76] Inventor: Miljenko Schiattino, Rivadavia 986, Piso 9, of. 33, (1002), Buenos Aires, Argentina

[21] Appl. No.: 172,386

[22] Filed: Dec. 23, 1993

Related U.S. Application Data

[63] Continuation-in-part of Ser. No. 6,945, Jan. 21, 1993, abandoned.

[30] Foreign Application Priority Data

Jul. 20, 1992 [AR] Argentina ..... 322785

[51] Int. Cl.[6] ..... F01L 5/04

[52] U.S. Cl. ..... 123/190.2; 123/190.16; 123/190.17

[58] Field of Search ..... 123/190.1, 190.16, 190.6, 123/190.8, 190.2, 190.17; 277/53, 54

[56] References Cited

U.S. PATENT DOCUMENTS

| | | | |
|---|---|---|---|
| 924,897 | 6/1909 | Emmet | 277/54 |
| 1,041,485 | 10/1912 | Kieser | 277/54 |
| 2,183,024 | 12/1939 | Large . | |
| 2,543,615 | 2/1951 | Trumpler | 277/53 |
| 2,839,036 | 6/1958 | Strang . | |
| 3,871,340 | 3/1975 | Zimmerman . | |
| 3,945,364 | 3/1976 | Cook . | |
| 3,993,036 | 11/1976 | Tischler . | |
| 4,019,487 | 4/1977 | Guenther . | |
| 4,163,438 | 8/1979 | Guenther et al. . | |
| 4,198,946 | 4/1980 | Rassey . | |
| 4,333,427 | 6/1982 | Burillo et al. . | |

(List continued on next page.)

FOREIGN PATENT DOCUMENTS

| | | |
|---|---|---|
| 0059047 | 9/1982 | European Pat. Off. . |
| 0099873 | 2/1984 | European Pat. Off. . |
| 741463 | 2/1933 | France . |
| 1053298 | 2/1954 | France . |

(List continued on next page.)

OTHER PUBLICATIONS

English translation of Japanese Abstract, Publication No. JP60125712, re application No. JP830234468 (Jul. 5, 1985), Applicant: Y. Tsukamoto.

English translation of Japanese Abstract, Publication No. JP3172521, re application No. JP890213710 (Jul. 25, 1991), Applicant: K. Tomita.

"Manual del Constructor de Máquinas", F. Sass et al., Editorial Labor, S.A. (Pub. 1969).

"Calderas Máquinas de vapor", Bähr, et al., Editorial Labor, S.A., (Pub. 1969).

"Capitulo XIV, La Distribución", pp. 274–275.

"Calculo de Elementos de Maquinas", Vallance, et al., (List continued on next page.)

*Primary Examiner*—Henry C. Yuen

*Assistant Examiner*—Erick Solis

*Attorney, Agent, or Firm*—Michael D. Bednarek; Marks & Murase

[57] ABSTRACT

A double-effect distribution sequential valve shaft assembly for use within a cylinder head cover of internal combustion engines or other valve-type distribution systems, includes a rotating valve shaft with openings from side to side in the vertical plane and a jacket supporting the valve shaft for rotation therein. An opening in the valve shaft communicates through diametrically opposed openings in the jacket with the combustion chamber twice during every turn of the valve shaft to regulate the flow of gases into and out of the combustion chamber. The jacket is provided with a series of labyrinths etched into an inner surface thereof to create a barrier to gases flowing out of the combustion chamber during the compression and explosion strokes. The jacket is also provided with a plurality of circumferential grooves formed in the inner surface thereof to form a high pressure fluid seal when lubricating oil is introduced therein under pressure. The sequential valve shaft thus has a very high closing efficiency and heat transfer properties in all phases of operation.

31 Claims, 4 Drawing Sheets

U.S. PATENT DOCUMENTS

| | | | |
|---|---|---|---|
| 4,404,934 | 9/1983 | Asaka | 123/190.17 |
| 4,541,371 | 9/1985 | Kageyama et al. . | |
| 4,545,337 | 10/1985 | Lyons et al. . | |
| 4,556,023 | 12/1985 | Giocastro et al. . | |
| 4,738,233 | 4/1988 | Hitomi et al. . | |
| 4,815,428 | 3/1989 | Bunk . | |
| 4,832,350 | 5/1989 | Orlowski | 277/53 |
| 4,864,984 | 9/1989 | Blish . | |
| 4,887,567 | 12/1989 | Matsuura et al. . | |
| 4,960,086 | 10/1990 | Rassey . | |
| 4,976,227 | 12/1990 | Draper . | |
| 4,995,354 | 2/1991 | Morikawa . | |
| 5,052,349 | 10/1991 | Buelna | 123/190.14 |
| 5,074,265 | 12/1991 | Ristin et al. . | |
| 5,105,784 | 4/1992 | Davis et al. . | |

FOREIGN PATENT DOCUMENTS

| | | |
|---|---|---|
| 2547867 | 12/1984 | France . |
| 61-237825 | 10/1986 | Japan . |
| 2190139 | 11/1987 | United Kingdom . |

OTHER PUBLICATIONS

Libreria y Editorial Alsina, FIG. 167 (Pub. 1959).

"Motores Endotermicos", D. Giacosa, Editorial Dossat, S.A., FIG. 421, pp. 559–560 (1955).

"Turbinas de Vapor", p. 520, publisher unknown.

"Principios para Construcciones y Calculo", pp. 405–406 with English translation, publisher and author unknown.

"Máqunias Motrices Rotativas", p. 459 with English translation, publisher and author unknown.

Advertisement, Elliott Overseas Corporation, 1969, with English translation.

Advertisement for dry piston non-lubricated compressors, Published in "Revista Technológica", p. 31 with English translation.

Sales brochure for shaft seals, specifically Labyrinth and Dry Carbon Ring, from Elliott Iso-Seals, Bulletin P-25B.

Sales bulletin Boletin H-32S for Turbina tipo Ayr con mecanoaccionamiento, Elliott Corporation, 1969.

31

α
31

22
34

34
20
22
33
30
33
E
E
34
32
32
35
1
2

DOUBLE EFFECT DISTRIBUTION SEQUENTIAL VALVE SHAFT ASSEMBLY

BACKGROUND OF THE INVENTION

This application is a continuation-in-part of applicant's copending U.S. Application Ser. No. 08/006,945, filed Jan. 21, 1993, now abandoned, and claims the benefit of the earlier filing date of such application under 35 U.S.C. §120.

1. Field of the Invention

The present invention relates to a device to be used in any machine which uses a valve distribution system and especially for use in internal combustion engines. More particularly, the present invention relates to a double effect distribution sequential valve shaft assembly with a high closing efficiency for use in an internal combustion engine.

2. Description of the Prior Art

The present invention will be described by illustrating its operation in an internal combustion engine with spark ignition. Thus, as background, one of the most common valve distribution systems for a four stroke gasoline engine will be described briefly. The valve in such a system is a rod with a small plate on one extreme which has a conical seat for shutting the opening to the cylinder head, due to the effect of a spring fixed to it.

The valve slips inside a guide, and the opening and closing of the cylinder is done by a rocker arm which pushes it to its extreme or, when the pressure of the rocker arm ceases, it closes the conduit by the effect of the spring. The movement of the rocker arm is carried out by a camshaft which transmits the sequence of opening and closing of each one of the intake or exhaust valves. The camshaft is moved by the crankshaft by means of a chain, cogwheels or a dented belt with a rotational speed equal to ½ that of the crankshaft in a four stroke engine (Otto cycle).

While the above-described conventional system is currently used in a large majority of four-stroke gasoline engines manufactured today, an alternative valve arrangement has also been provided. For example, in European Patent No. 0 059 047 issued to Baldwin, a rotary valve arrangement is disclosed having two longitudinal valve shafts rotatably mounted within the cylinder head cover and aligned with the engine axis. The valve shafts are cylindrical in shape and each include a radial passageway for controlling the flow of fluid into and out of the combustion chamber as the valves rotate. One of the valve shafts communicates with an inlet port leading into the combustion chamber, and the other communicates with an exhaust port.

In operation of the device of Baldwin, since the radial passageways extend through the valve shafts from side to side, the valves open twice for each complete rotation of the valve shaft. For this reason, the valve shaft is typically called a "double effect sequential valve shaft." Because of this double effect, one complete turn of the crankshaft need only correspond to ¼ of the turn of the double effect distribution sequential valve shaft, instead of ½ turn as in a conventional camshaft. The rotation is typically transmitted from a pulley on the crankshaft by means of pulleys and toothed belts, with a corresponding difference of diameters to reduce the number of turns to a 4:1 ratio.

The above described operation of Baldwin is generally similar to the operation of the sequential rotary valve shaft of the present invention. Various other rotary valve systems are also disclosed in the prior art, including, for example, U.S. Pat. No. 4,960,086 issued to Rassey, U.S. Pat. No. 4,198,946 issued to Rassey, U.S. Pat. No. 4,163,438 issued to Guenther et al., U.S. Pat. No. 4,019,487 issued to Guenther, U.S. Pat. No. 2,183,024 issued to Large, and European Patent No. 0 099 873 issued to Illichmann.

In the above-mentioned prior rotary valve systems, various problems exist including low closing efficiencies, high friction operation, inferior cooling capacities, complexity, or a combination of all of these. For example, U.S. Pat. No. 4,960,086 to Rassey discloses a rotary valve construction that includes grooved seals provided as separate ceramic inserts between adjacent valve portions. Since the grooved seals rotate with the shaft, the shaft cannot be moved axially without also displacing the seals. Thus, this form of seal precludes axial movement of the shaft to adjust the size of the valve opening. In addition, in Rassey sealing is provided entirely by an air seal, which creates heat and requires a ceramic bushing. There is no means for introducing lubricant around the valve shafts to reduce friction and create a high pressure fluid seal. Moreover, although the seal shown is described as a "labyrinth" seal it includes only one or two spiral grooves. Such spiral grooves when fixed to a rotating shaft tend to impel the pressurized fluid along the inclined rotating channel edges. Since the spiral grooves are formed on the shaft, the centrifugal force in the grooves during operation tends to force particles to the interface between the valve shaft and the bore thereby reducing the effectiveness of the grooves for creating pressure barriers. Finally, because the valve and bushing portions are separate, assembly of the valve construction is complicated.

The present invention provides an improved double effect sequential valve system which overcomes the problems of the prior art systems.

SUMMARY OF THE INVENTION

The present invention relates to a double effect distribution sequential valve shaft assembly for use in an internal combustion engine or in any other type of apparatus requiring a valve-type distribution system. The device of the present invention is an improvement over the above-mentioned prior art double effect sequential valve systems in its superior performance and low cost of manufacturing. The improvements and advantages of the present invention have not previously been achieved by the existing systems.

It is thus an object of the present invention to provide a sequential valve shaft assembly with a high closing efficiency, and improved heat transfer and lubrication capabilities.

It is a further object of the present invention to provide a sequential valve shaft assembly with a high closing efficiency in all phases of operation, including an initial start-up period where the high pressure fluid seal is inoperative.

It is a further object of the present invention to provide an internal combustion engine with a sequential valve shaft assembly having a very high closing efficiency in all phases of operation.

It is a further object of the present invention to provide a sequential valve shaft assembly that is simple and inexpensive to manufacture.

It is a further object of the present invention to provide a sequential valve shaft assembly that uses a combination of labyrinths and fluid seals to achieve an effective pressure barrier in all phases of operation.

It is a further object of the present invention to provide a sequential valve shaft assembly having a series of circumferential labyrinth grooves, a series of axially extending labyrinth grooves, and a plurality of annular fluid sealing grooves all formed in an interior wall of a cylindrical jacket fitted about a rotating valve shaft with a close tolerance.

Additional objects, advantages and novel features of the invention will be set forth in the description which follows, and will become apparent to those skilled in the art upon reading this description or practicing the invention. The objects and advantages of the invention may be realized and attained by the appended claims.

To achieve the foregoing and other objects and in accordance with the purpose of the present invention, as embodied and broadly described herein, the device of this invention may comprise a double effect distribution sequential valve shaft assembly for regulating the flow of gases into a compression chamber, including a hollow cylindrical jacket having a longitudinal axis and an interior surface, the jacket including at least one pair of diametrically opposed openings extending through the walls of the jacket providing communication to the compression chamber, and a cylindrical valve shaft rotatably supported within the jacket with a close tolerance fit therein, the valve shaft including at least one opening extending diametrically therethrough such that when the opening extending through the valve shaft is aligned with the diametrically opposed openings through the walls of the jacket a passage to the compression chamber is open, but when the opening extending through the valve shaft is not aligned with the openings through the walls of the jacket the passage to the compression chamber is closed, the jacket having a series of parallel, circumferential labyrinth grooves etched in the interior surface on each axial side of the pair of diametrically opposed openings through the jacket for creating a pressure barrier to prevent gases from escaping in an axial direction between the valve shaft and the jacket. Because the grooves are etched directly on the jacket, the jacket can be formed as a single piece. This one-piece construction greatly simplifies assembly of the present invention.

In a further aspect of the present invention, the device hereof may also comprise at least one annular groove disposed in the midst of each series of circumferential labyrinth grooves on each axial side of the pair of diametrical openings through the jacket, and fluid ports for introducing a lubricating fluid into the annular groove to create a high pressure fluid seal to further prevent gases from escaping in an axial direction between the valve shaft and the jacket. This construction makes it possible to provide the grooves directly on the jacket, without need for a separate ceramic piece as in the prior art.

In a still further aspect of the present invention, the device hereof may also comprise a series of parallel, axially extending labyrinth grooves etched into the interior surface of the jacket adjacent each side of one opening of the pair of diametrical openings through the jacket, the axially extending grooves creating a pressure barrier to prevent gases from escaping between the diametrical openings in the jacket when the opening through the valve shaft is not in alignment with the pair of diametrical openings through the jacket.

In a preferred embodiment of the present invention, two longitudinal valve shaft assemblies are provided on a cylinder head cover, aligned with the engine axis. Each valve shaft assembly includes a jacket and a holed shaft mounted for rotation within the jacket (i.e., a shaft formed with a plurality of spaced holes or openings extending diametrically therethrough). Both valve assemblies are housed in a cylinder head cover of an appropriate design. The cylinder head cover is water cooled and has upper and lower openings which coincide with openings in each of the jackets. Each lower opening of the cylinder head cover communicates with a combustion chamber of a respective cylinder of the engine. The upper openings of the cylinder head cover communicate respectively with either the intake or the exhaust manifolds. Each longitudinal valve shaft is mounted inside its respective jacket with a very close tolerance fit and has openings extending through the shaft from side to side in the vertical plane.

Each valve shaft opening is separated from the other by the distance between cylinder centers and is placed at a predetermined angle in the vertical plane, depending on its function in the sequence of intake or exhaust and the relative timing of the individual cylinders. In operation, each of the valve shafts rotate only ¼ turn for each complete turn of the crankshaft. One of the ends of the valve shaft has a seeger ring and a bolted cover to permit longitudinal expansion only in the direction opposite to the pulleys. (See FIG. 2A).

A key improvement of the present invention over the above-mentioned prior art lies in its provision of annular grooves and labyrinths formed on an interior wall of the cylindrical jackets to enhance the closing efficiency and heat dissipation of the valve system during operation. The present invention includes a series of parallel, circumferential labyrinth grooves etched into the interior wall of the cylindrical jackets between each adjacent cylinder, and a series of parallel, axially extending labyrinth grooves etched into the interior wall of the cylindrical jackets adjacent the lower openings in the jackets. In addition, an annular fluid seal groove is formed in the interior wall of the jackets in the midst of the circumferential labyrinth grooves. The annular fluid seal groove communicates with a supply of pressurized lubricating oil and forms a high pressure fluid seal during engine operation. The oil acts as a lubricant and also provides a medium for transferring heat generated during operation of the valve assembly. Thus, the combination of the labyrinth seal and the fluid seal satisfies three distinct needs: heat transfer; lubrication and containment of pressure. Additional annular oil groove seals are formed in the interior wall of the jackets adjacent each of the series of labyrinths for providing an additional high pressure fluid seal during engine operation.

BRIEF DESCRIPTION OF THE DRAWINGS

The accompanying drawings, which are incorporated in, and form part of, the specification, illustrate an embodiment of the present invention and, together with the description serve to explain the principles of the invention. In the drawings.

DETAILED DESCRIPTION OF THE PREFERRED EMBODIMENT

Figure 1A:
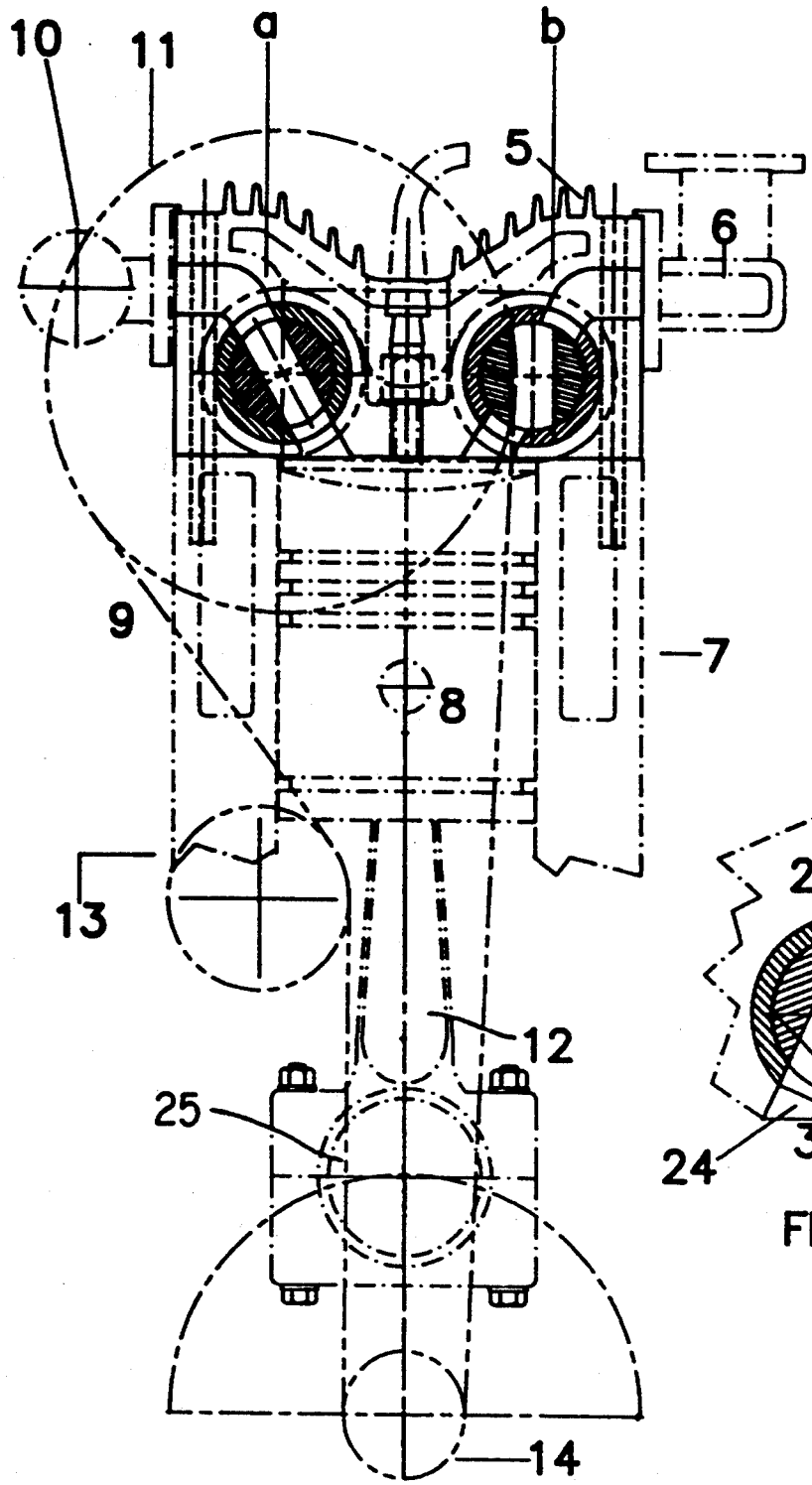
FIG. 1A is a cross-sectional view of a cylinder and the sequential distribution valve system of the present invention with the piston and the remainder of the cylinder illustrated in phantom.

Reference will now be made in detail to the preferred embodiment of the invention, an example of which is illustrated in the accompanying drawings.

The present invention includes two longitudinal shafts (a) and (b) on the cylinder head 5 aligned with the engine axis, comprising a jacket 1 and a shaft 2 formed with holes, i.e., a holed shaft. The engine includes a motor block 7, pistons 8, a cylinder head 5, connecting rod 12, crankshaft 25, a distribution toothed belt 9 (timing belt), distribution and reduction toothed pulley 11, belt tensioner 13, and motion distribution toothed pulley 14.

Since both shafts (a) and (b) (intake and exhaust) are practically identical, only one of them will be described in detail. A housing for two jackets is provided in the cylinder head cover 5, the cylinder head cover 5 having outer water chambers surrounding the jacket housing for cooling. A jacket 1, with perforations or openings 20 from side to side in the vertical plane of the jacket, is inserted into the housing under pressure and with a sealer. Each opening 20 coincides with a combustion chamber of one cylinder of the engine. In accordance with one aspect of the present invention, the jacket is preferably of a unitary one-piece construction. This greatly simplifies machining of the assembly and its insertion in the housing.

A double effect distribution sequential valve shaft 2 is mounted inside the jacket 1 with a very accurate tolerance. The shaft also has perforations or openings 22 extending from side to side in the vertical plane. Each opening 22 corresponds with an inlet or exhaust port into a respective combustion chamber of the engine. The openings 22 are separated from each other along the length of the valve shaft 2 by at least the distance between adjacent cylinders and are placed at a predetermined angle in the vertical plane, depending on the sequence of intake or exhaust and the type of engine.

Figure 1B:
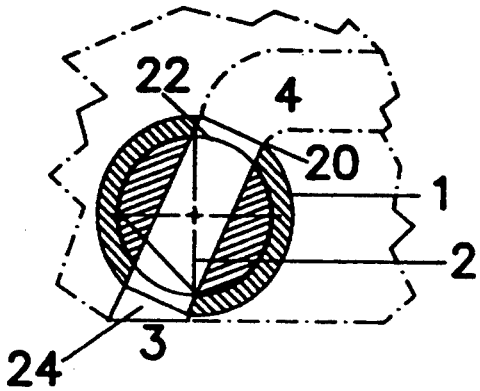
FIG. 1B is a detail view of a portion of the present invention as shown in FIG. 1A.

Because the openings 22 extend through the shaft 2 from side to side in the vertical plane, at every complete turn, one of the openings 22 communicates twice through an opening 20 in the jacket 1 with a hole 24 in the head of one combustion chamber of a given cylinder 3, for which reason it is named a "double effect distribution sequential valve." Thus, one complete turn of the crankshaft need only result in ¼ of a turn of the double effect distribution sequential valve shaft 2. The rotation of the valve shaft 2 is transmitted from a pulley 14 on the crankshaft 25 by means of a toothed belt 9 and a pulley 11. A corresponding difference of diameters between the pulley 11 and the pulley 14 reduces the number of turns of the valve shaft 2 to 1:4 with respect to the crankshaft. The exhaust or intake port in the cylinder head cover 5 is shown at 4 in FIG. 1B, with the lower end of the port in communication with the cylinder 3 shown at 24.

Figure 2A:
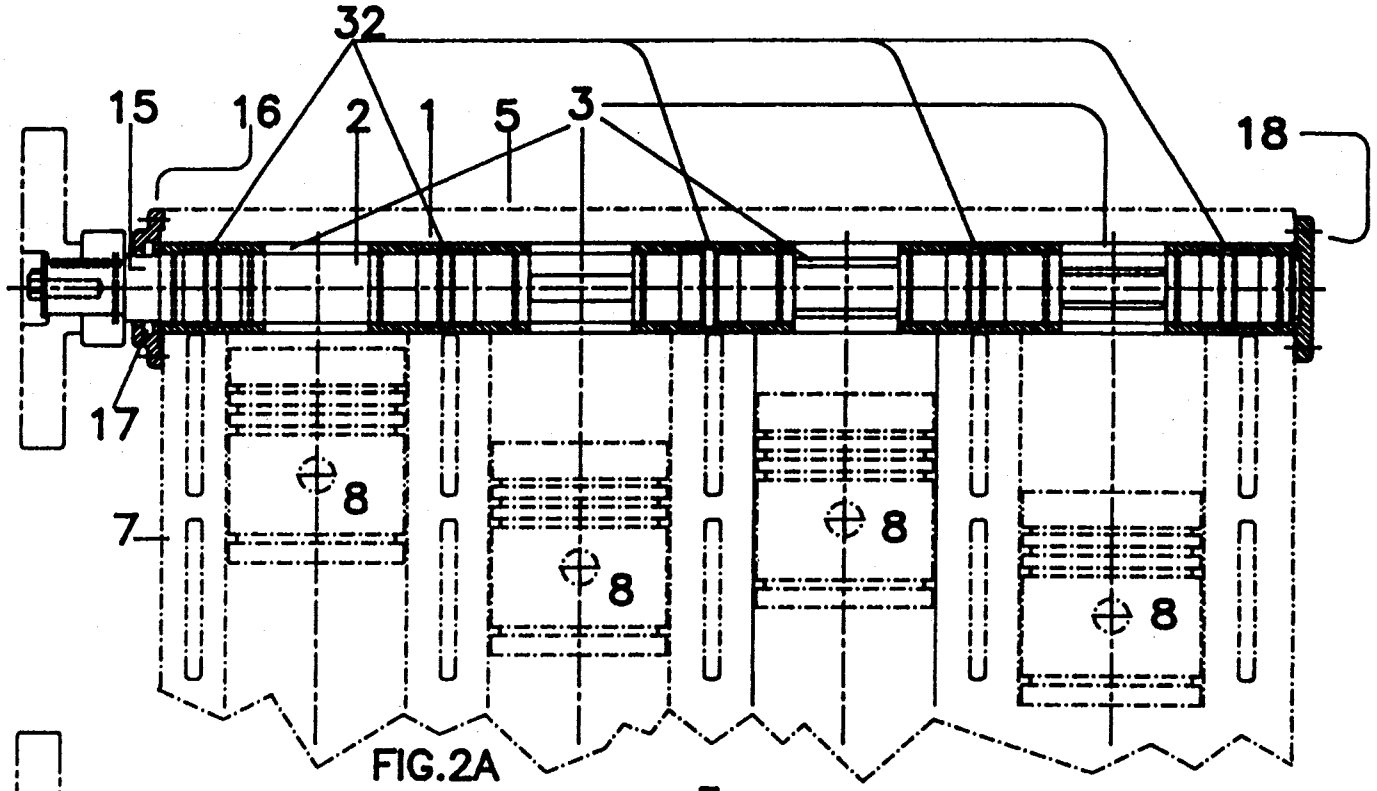
FIG. 2A is a side view, partially in section, of the present invention used in conjunction with multiple cylinders.
Figure 2B:
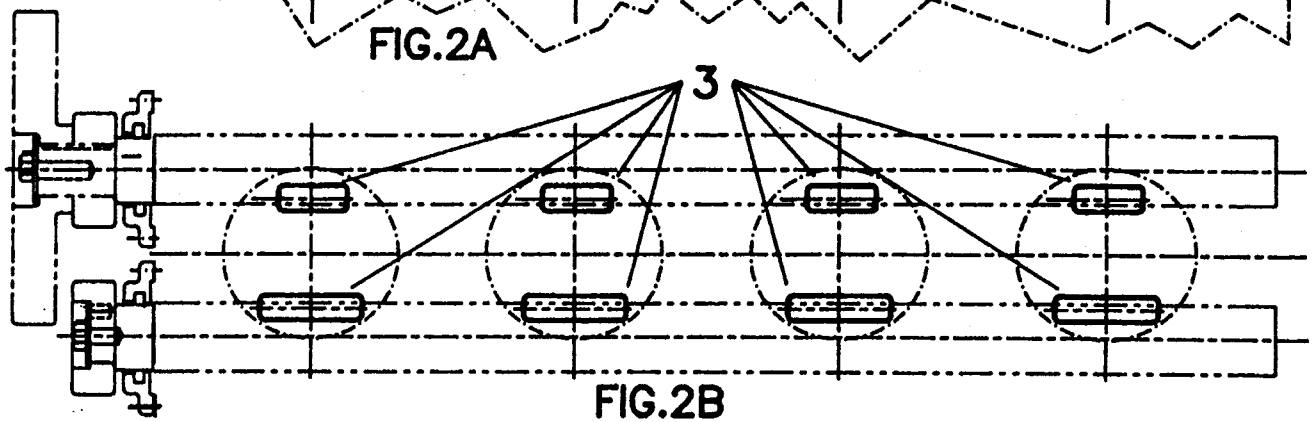
FIG. 2B is a top view of the valve shaft of FIG. 2A.

As shown in FIG. 2A, one of the ends of the valve shaft has a seeger ring 15 and a bolted cover 16 to limit the longitudinal expansion of the valve shaft in the direction opposite to the pulleys. The cover 16 which limits the movement of the seeger ring 15 has a double tip rubber lock 17. A back locking cover is shown at 18.

As it has been shown, a sequence of opening and closing of communication to the cylinder with an intake duct 6 or an exhaust duct 10 has been achieved with the perforated jacket 1 and the valve shaft 2 with openings 22 at different angles. This mechanism replaces the camshaft, rocker arms, push rods, valve guides, springs of push rods, cushions, plates of spring retention and valve covers of the typical reciprocating valve systems. The description of the intake valve shaft is identical to that of the exhaust valve shaft.

The closing efficiency of the system is achieved with a novel arrangement of labyrinths and fluid seals to obtain a very high closing efficiency without the disadvantages of the prior art systems. As shown in FIGS. 3A–3D, the present invention includes a series of labyrinths 34 etched into an internal surface of the jacket 1. The labyrinths 34 are in the form of a series of circumferential parallel grooves etched into the jacket 1 along a portion of the jacket on each side of the openings 20. As will be more fully explained below, the labyrinths 34 function to create a barrier of turbulent gas flow which opposes the escape of gases from the combustion chamber during engine operation to enhance the closing efficiency of the valve system. Because the labyrinths are in the form of circumferential parallel grooves, rather than spiral grooves, they have no tendency to impel pressurized fluid.

Figures 3A, 3B, 3C, 3D:
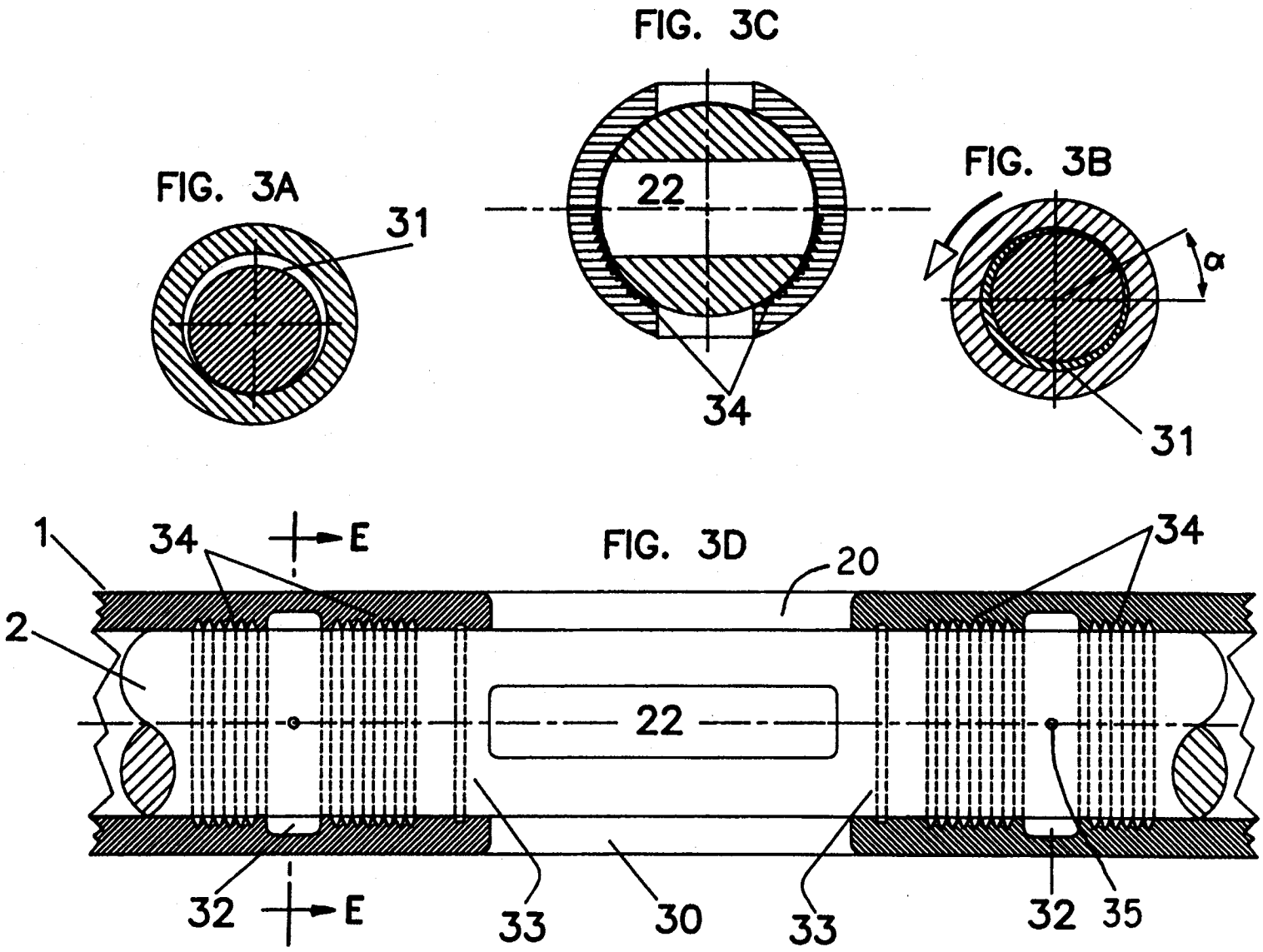
FIGS. 3A, 3B and 3C are sectional end views of the valve shaft of the present invention.
FIG. 3D is a sectional side view of the valve shaft of the present invention.
Figure 3E:
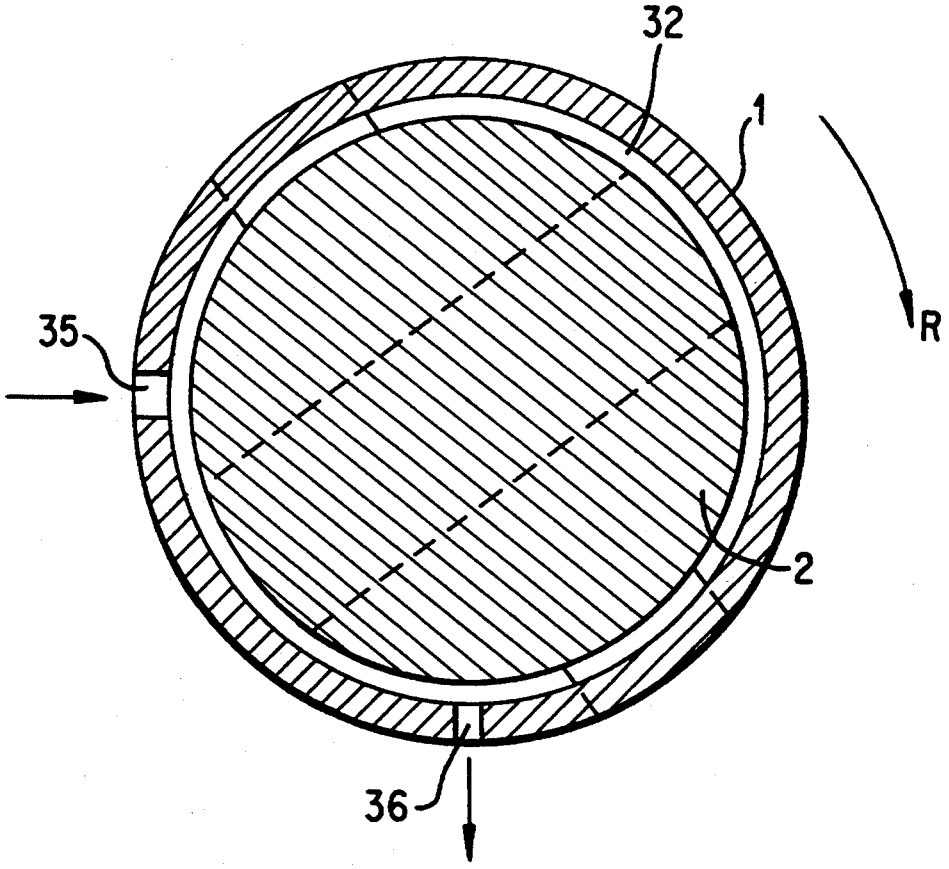
FIG. 3E is a sectional end view of the valve shaft of the present invention taken along line E—E in FIG. 3D.

In the midst of each series of circumferential labyrinths 34 is a fluid seal groove 32 having an oil entry port 35 in fluid communication with the lubricating system of the engine or independent lubrication system. During operation, the fluid seal groove 32 fills with oil and provides an effective high pressure fluid seal to ensure a very high closing efficiency of the valve system. As shown in FIG. 3E, the oil entry port 35 is accompanied by an oil exit port 36 to allow circulation of lubricating oil through the groove 32 during operation. The oil exit port 36 has a smaller diameter than the entry port 35 so that the circulating oil maintains a fluid pressure within the groove 32. The entry and exit ports 35 and 36 are circumferentially spaced such that the direction of rotation R of the valve shaft 2 tends to distribute the entering oil about the circumference of the groove before it exits the groove via port 36. The oil circulating through the groove 32 enhances the heat transfer away from the valve shaft to help cool the valve system during operation. The oil is further cooled on the jacket 1 by water circulating through the water chambers of the cylinder head cover 5.

Additional fluid seal grooves 33 are formed in the jacket 1 adjacent the openings 20 to provide secondary fluid seals to further enhance the closing efficiency and improve heat transfer. The grooves 33 are preferably in fluid communication with the lubrication system so that they maintain fluid pressure about the shaft 2 similar to the grooves 32.

A series of axially extending labyrinth grooves 34A (FIG. 3C) are etched into the inner surface of the jacket 1 adjacent each side of a lower portion 30 of the openings 20. The axially extending labyrinth grooves 34A extend at least the length of the openings 20 and function to create an additional barrier of turbulent gas flow which opposes the escape of gases towards the upper portion of the openings 20.

As is obvious from the above discussion, all of the sealing means are provided in the jackets which do not rotate with the shafts. This provides several advantages over some prior art constructions in which the seal means rotates with the shaft. To begin with, the construction of the present invention provides better sealing between the shaft and the jacket. Both of these pieces can be manufactured to the close tolerances required for effective sealing better than the cylinder heads and jackets of the prior art. Moreover, since the seal does not move with the shaft, it is possible to displace the shaft axially as described in applicant's copending U.S. Patent applications, Ser. Nos. 08/006,944 and 08/095,549, to adjust the size of the valve openings without destroying the seal. Finally, the sealing interface between the shaft and the jacket is located at the radially innermost portion of each groove. Thus, centrifugal forces acting on the fluid will tend to push the fluid away from the sealing interface into the grooves, rather than toward the sealing interface as is the case when the grooves are formed in the shaft or on an element that rotates with the shaft.

The novel features of the present invention will now be further described with reference to two phases of engine operation. The first phase of operation occurs when the engine is first being started and may last for a short time after the engine starts. In the first phase, as represented by FIG. 3A, the lubricating system of the engine is either inoperative or has not yet reached its normal operating pressure. In FIG. 3A it can be seen that the valve shaft is without an oil cushion or bearing supporting it in a sealed fit within the jacket in the first phase of operation (i.e, the minute space 31 between the shaft 2 and jacket 1 is dry). It is to be noted that the close tolerance fit of the valve shaft 2 within the jacket 1 is greatly exaggerated in FIG. 3A for explanatory purposes. Without sufficient oil pressure, the fluid seal grooves 32 and 33 do not provide effective fluid seals. Thus, in the first phase of operation, the closing efficiency of the valve system largely depends on the close tolerance fit between the jacket 1 and shaft 2 and the pressure barriers created by the labyrinths 34 and 34A.

During operation, the gases in each cylinder tend, at the moment of compression, to try to escape about the outer surface of the valve shaft 2 towards adjacent combustion chambers 3 and towards the upper openings 20 through the jacket 1. Since the flow of any escaping gases is turbulent, the labyrinths 34 and 34A create a pressure barrier or brake to substantially reduce the above-mentioned gas escape. The braking effect grows exponentially as a square of the speed of the gases. In other words, the greater the speed of the gases (given by the ratio of compression, the pressure of explosion, and the size of the conduits of escape 31), the greater the resistance to the passage of gas produced by the turbulence, and hence, the barrier created by the labyrinths 34 and 34A. The labyrinths 34 and 34A increase the turbulence by opposing an irregular surface transverse to the direction of flow. In addition, the labyrinths cause a loss of energy of the escaping gases as they expand into one groove after the other.

In sum, due to the high pressure, the close tolerances resulting in narrow passages, and the extremely short span of time involved, an effective barrier of counterpressure is produced in the initial phase of engine operation by the labyrinths 34 and 34A. This barrier opposes the escape of gas and results in a system with great closing efficiency, especially in a system having a high range of revolutions per minute and a relatively high ratio of compression.

In the second phase of operation, as represented by FIG. 3B, the lubrication system of the engine is up to operating pressure so that the fluid seal grooves 32 and 33 are filled with pressurized oil, and the minute space 31 between the shaft 2 and the jacket 1 is effectively filled by a film of oil. The lubricating oil enters and exits the annular grooves 32 and 33 under high pressure producing a hydrodynamic barrier to gases seeking to escape in the axial direction along the valve shaft 2 between the cylinders. The close tolerance fit of the valve shaft 2 within the jacket 1 is crucial to effective sealing operation of the fluid seals provided by the grooves 32 and 33.

The circumferential labyrinths 34 may fill up with oil during the second phase of operation to such an extent that they no longer function as labyrinths to dissipate the pressure in escaping gases. However, the distribution of oil throughout the labyrinth grooves 34 further enhances the fluid pressure barrier in the second phase of operation and helps reduce friction and dissipate heat in the system.

On the other hand, the area of the jack 1 swept by the holes 22 of the valve shaft 2 is largely deprived of lubrication by virtue of the oil-trapping function of the annular grooves 33. The oil film is necessarily broken by the successive passage of the holes 22 in front of the openings 20 and 30 in the jacket 1. Therefore, the minute space 31 extending between the annular grooves 33 in front of the openings 20 and 30 in the jacket will not contain oil. The shaft 2 maintains its position within the jacket because it is "floating" in an oil bed created along the lubricated sections of the assembly (i.e., between the annular grooves 32 and 33).

In the absence of an oil film, pressure containment is provided by the axial labyrinths 34A, which remain operable in both the first and second phases of operation. The location of such axial labyrinths, at each side of the lower opening in the jacket, is intended to provide energy dissipation for the gases which would escape from the cylinder in the critical compression and explosion strokes of the engine.

The novel design of the double effect distribution sequential valve shaft system of the present invention provides significant advantages over the prior art systems. First, the labyrinths 34 and 34A provide an effective pressure barrier in the start-up period of the engine when the valve shaft assembly is without oil lubrication. Second, the annular grooves 32 and 33 create high pressure fluid seals within the close tolerance fit of the assembly after the engine has run long enough for oil pressure to build up in the cavities 32 and 33. Third, lubrication and cooling are enhanced for the valve assembly during operation via oil circulation, oil cooling and water jackets. Thus, in terms of pressure containment, lubrication and cooling, the present invention provides a totally integrated system with superior operating capabilities in all phases of engine operation.

The shape of the openings in the valve shaft and the projections thereof may be arcs, open or closed and combinations thereof. The concentric jacket 1 may be part of the cylinder head cover 5 or a separate replaceable part. Further, all the openings from side to side, corresponding to intake and exhaust, may be on the same shaft. The double effect distribution sequential valve shaft may be made of any kind of material adequate to maintain its functioning, such as metal, carbonite, ceramic, KEVLAR ® or their alloys or combinations.

The double effect distribution sequential valve shaft may be located anywhere on or over the cylinder head or to the side of the engine block. The rotation of the double effect distribution sequential valve shaft 2 may be transmitted in an indirect way by a chain toothed belt, gearing or any other known transmission system.

The illustrated embodiment was chosen and described in order to best explain the principles of the invention and its practical application to thereby enable others skilled in the art to best utilize the invention in various embodiments and with various modifications as are suited to the particular use contemplated. It is intended that the scope of the invention only be limited by the claims appended hereto.

I claim:

1. A double effect distribution sequential valve shaft assembly for regulating the flow of gases into a compression chamber, comprising:

a hollow cylindrical jacket having a longitudinal axis and an interior surface, said jacket including at least one pair of diametrically opposed openings extending through the walls of the jacket providing communication to the compression chamber; and a cylindrical valve shaft rotatably supported within said jacket with a close tolerance fit therein, said valve shaft including at least one opening extending diametrically therethrough such that when the opening extending through the valve shaft is aligned with the diametrically opposed openings through the walls of the jacket a passage to the compression chamber is open, but when the opening extending through the valve shaft is not aligned with the openings through the walls of the jacket the passage to the compression chamber is closed;

said jacket comprising a plurality of parallel, contiguous, circumferential grooves forming a radial labyrinth etched in said interior surface on each axial side of said pair of diametrically opposed openings through said jacket for creating a pressure barrier to prevent gases from escaping in an axial direction between said valve shaft and said jacket;

said jacket further comprising a plurality of parallel, contiguous grooves axially extending along and etched into said interior surface of said jacket adjacent one opening of said pair of diametrical openings in said jacket, said axially extending grooves creating a pressure barrier to prevent gases from escaping from said one opening to the other opening of said pair of diametrical openings when said opening through said valve shaft is not in alignment with said pair of diametrical openings through said jacket.

2. The valve shaft assembly according to claim 1, further comprising at least one annular groove disposed on each axial side of said pair of diametrical openings through said jacket, and means for introducing a lubricating fluid into said annular groove to create a high pressure fluid seal to further prevent gases from escaping in an axial direction between said valve shaft and said jacket.

3. The valve shaft assembly according to claim 2, wherein said at least one annular groove includes an annular groove disposed in the midst of each of said radial labyrinths.

4. The valve shaft assembly according to claim 3, wherein said at least one annular groove further includes an annular groove disposed between said radial labyrinths and said pair of diametrical openings through said jacket.

5. A double effect distribution sequential valve shaft assembly for regulating the flow of gases into a compression chamber, comprising:

a hollow cylindrical jacket having a longitudinal axis and an interior surface, said jacket including at least one pair of diametrically opposed openings extending through the walls of the jacket providing communication to the compression chamber; and a cylindrical valve shaft rotatably supported within said jacket with a close tolerance fit therein, said valve shaft including at least one opening extending diametrically therethrough such that when the opening extending through the valve shaft is aligned with the diametrically opposed openings through the walls of the jacket a passage to the compression chamber is open, but when the opening extending through the valve shaft is not aligned with the openings through the walls of the jacket the passage to the compression chamber is closed;

said jacket having a plurality of parallel, contiguous, circumferential grooves forming a radial labyrinth etched in said interior surface on each axial side of said pair of diametrically opposed openings through said jacket for creating a pressure barrier to prevent gases from escaping in an axial direction between said valve shaft and said jacket;

at least one annular groove disposed on each axial side of said pair of diametrical openings through said jacket, and means for introducing a lubricating fluid into said annular groove to create a high pressure fluid seal to further prevent gases from escaping in an axial direction between said valve shaft and said jacket;

said at least one annular groove including an annular groove disposed in the midst of each of said radial labyrinths and an annular groove disposed between said radial labyrinths and said pair of diametrical openings through said jacket;

said means for introducing lubricating fluid including entry and exit ports to provide oil circulation through said annular groove during operation.

6. The valve shaft assembly according to claim 5, further comprising a plurality of parallel, contiguous grooves axially extending along and etched into said interior surface of said jacket forming an axial labyrinth adjacent one opening of said pair of diametrical openings through said jacket, said axially extending grooves creating a pressure barrier to prevent gases from escaping from said one opening to the other opening of said pair of openings when said opening through said valve shaft is not in alignment with said pair of diametrical openings through said jacket.

7. The valve shaft assembly according to claim 6, wherein said axial labyrinth is etched into said interior surface on the lower part of said jacket at each side of said one opening, and wherein said axially extending grooves are identical with one another.

8. The valve shaft assembly according to claim 7, wherein said pair of openings through said jacket and said opening through said valve shaft are elongated in an axial direction of said valve shaft.

9. The valve shaft assembly according to claim 8, wherein said valve shaft and said jacket each include a plurality of openings spaced along a length thereof.

10. The valve shaft assembly of claim 5, wherein said means for introducing lubricating fluid is independent from a general lubricating system of the engine.

11. A double effect distribution sequential valve shaft assembly for regulating the flow of gases into a compression chamber, comprising:

a hollow cylindrical jacket having a longitudinal axis and an interior surface., said jacket including at least one pair of diametrically opposed openings extending through the walls of the jacket providing communication to the compression chamber;

a cylindrical valve shaft rotatably supported within said jacket with a close tolerance fit therein, said valve shaft including at least one opening extending diametrically therethrough such that when the opening extending through the valve shaft is aligned with the diametrically opposed openings through the walls of the jacket a passage to the compression chamber is open, but when the opening extending through the valve shaft is not aligned with the openings through the walls of the jacket the passage to the compression chamber is closed;

said jacket having a plurality of parallel, contiguous, circumferential grooves forming a radial labyrinth etched in said interior surface on each axial side of said pair of diametrically opposed openings through said jacket for creating a pressure barrier to prevent gases from escaping in an axial direction between said valve shaft and said jacket;

said jacket also comprising a plurality of parallel, contiguous grooves axially extending along and etched into said interior surface of said jacket adjacent one opening of said pair of diametrical openings in said jacket, said axially extending grooves creating a pressure barrier to prevent gases from escaping from said one opening to the other opening of said pair of diametrical openings when said opening through said valve shaft is not in alignment with said pair of diametrical openings through said jacket;

said axially extending grooves being etched into said interior surface on the lower part of said jacket at each side of said one opening, and wherein said axially extending grooves are identical with one another.

12. The valve shaft assembly according to claim 11, wherein said pair of openings through said jacket and said opening through said valve shaft are elongated in an axial direction of said valve shaft.

13. A double effect distribution sequential valve shaft assembly for controlling the intake and exhaust of gases in an internal combustion engine which includes an engine block, a cylinder formed in the engine block, the cylinder having a cylinder head, a piston slidable within the cylinder, a combustion chamber bounded by the cylinder and the piston, an intake passage in communication with the combustion chamber and an exhaust passage in communication with the combustion chamber, the valve shaft assembly comprising:

a unitary first hollow cylindrical jacket having a longitudinal axis, the hollow cylindrical jacket extending transverse to a first passage to the combustion chamber;

said hollow cylindrical jacket including at least one pair of diametrically opposed openings through the walls of the jacket providing communication through the first passage to the combustion chamber;

a cylindrical valve shaft provided with a close tolerance fit in the first hollow cylindrical jacket, said cylindrical valve shaft including a hole extending diametrically through the cylindrical valve shaft such that when the hole extending through the cylindrical valve shaft is aligned with the diametrically opposed openings formed in the walls of the hollow cylindrical jacket the first passage to the combustion chamber is open, but when the hole formed in the cylindrical valve shaft is not aligned with the openings formed in the walls of the hollow cylindrical jacket the first passage to the combustion chamber is closed;

radial labyrinths etched on an interior surface of said jacket, said radial labyrinths providing pressure seals which create a barrier of pressure which opposes the escape of gas from the combustion chamber in an axial direction along said valve shaft;

means for introducing a lubricant between said valve shaft and said jacket into an annular fluid seal groove formed in said jacket to create a high pressure fluid seal to further prevent gases from escaping in an axial direction between said valve shaft and said jacket, said lubricant introducing means including entry and exit ports through said valve jacket for providing oil circulation through said annular groove; and a valve drive for rotating the cylindrical valve shaft at least one-fourth of a turn for every complete turn of the crankshaft.

14. The valve assembly according to claim 13, further comprising a second unitary hollow cylindrical jacket having a longitudinal axis, the second hollow cylindrical jacket extending transverse to a second passage to the combustion chamber;

said second hollow cylindrical jacket including at least one pair of diametrically opposed openings through the walls of the jacket providing communication through the second passage to the combustion chamber; and a second cylindrical valve shaft provided with a close tolerance fit in the second cylindrical jacket, said second cylindrical valve shaft including a hole extending diametrically through the second cylindrical valve shaft such that when the hole extending through the cylindrical valve shaft is aligned with the diametrically opposed openings in the walls of the second hollow cylindrical jacket, the second passage to the combustion chamber is open, but when the hole extending through the second cylindrical valve shaft is not aligned with the openings formed in the walls of the second hollow cylindrical jacket the second passage to the combustion chamber is closed;

wherein said valve drive rotates said second cylindrical valve shaft at least one-fourth of a turn for every complete turn of the crankshaft;

radial labyrinths etched on an internal surface of said second jacket, said radial labyrinths on said second jacket providing pressure seals which create a barrier of pressure which opposes the escape of gases from the combustion chamber in an axial direction along said valve shaft; and means for introducing a lubricant between said second valve shaft and said second jacket.

15. The valve assembly according to claim 14, wherein said first passage to the combustion chamber is the intake passage and said second passage to the combustion chamber is the exhaust passage.

16. The valve assembly according to claim 13, wherein said cylindrical jacket forms part of the cylinder head.

17. The valve assembly according to claim 13, wherein said valve drive comprises pulleys and belts which transfer the rotation of the crankshaft to said valve shaft, the pulleys and belts having a difference in diameters to reduce the number of turns of the crankshaft to the valve shafts to four to one.

18. The valve assembly according to claim 13, wherein the cylinder head has water cooling jackets to cool the valve shaft and cylindrical jacket.

19. The valve shaft assembly according to claim 13, wherein said at least one annular fluid seal groove is disposed in the midst of each of said radial labyrinths.

20. The valve shaft assembly of claim 13, wherein said exit port has a smaller diameter than said entry port.

21. The valve shaft assembly of claim 13, wherein said means for introducing lubricant is independent from a general lubricating system of the engine.

22. A double effect distribution sequential valve shaft assembly for controlling the intake and exhaust of gases in an internal combustion engine which includes an engine block, a cylinder formed in the engine block, the cylinder having a cylinder head, a piston slidable within the cylinder, a combustion chamber bounded by the cylinder and the piston, an intake passage in communication with the combustion chamber and an exhaust passage in communication with the combustion chamber, the valve shaft assembly comprising:

a unitary first hollow cylindrical jacket having a longitudinal axis, the hollow cylindrical jacket extending transverse to a first passage to the combustion chamber;

said hollow cylindrical jacket including at least one pair of diametrically opposed openings through the walls of the jacket providing communication through the first passage to the combustion chamber;

a cylindrical valve shaft provided with a close tolerance fit in the first hollow cylindrical jacket, said cylindrical valve shaft including a hole extending diametrically through the cylindrical valve shaft such that when the hole extending through the cylindrical valve shaft is aligned with the diametrically opposed openings formed in the walls of the hollow cylindrical jacket the first passage to the combustion chamber is open, but when the hole formed in the cylindrical valve shaft is not aligned with the openings formed in the walls of the hollow cylindrical jacket the first passage to the combustion chamber is closed;

radial labyrinths etched on an interior surface of said jacket, said radial labyrinths providing pressure seals which create a barrier of pressure which opposes the escape of gas from the combustion chamber in an axial direction along said valve shaft;

means for introducing a lubricant between said valve shaft and said jacket;

a valve drive for rotating the cylindrical valve shaft at least one-fourth of a turn for every complete turn of the crankshaft;

at least one annular fluid seal groove disposed in the midst of each of said radial labyrinths, said means for introducing a lubricant including means for introducing a lubricant into said at least one annular sealing groove to create a high pressure fluid seal to further prevent gases from escaping in an axial direction between said valve shaft and said jacket;

said means for introducing a lubricant including entry and exit ports to provide oil circulation through said annular groove during operation.

23. The valve shaft assembly according to claim 22, further comprising axial labyrinths etched into said interior surface on the lower part of said jacket at each side of one opening of said pair of diametrical openings through said jacket, said axial labyrinths creating a pressure barrier to prevent gases from escaping from said one opening to the other opening of said pair of openings when said hole through said valve shaft is not in alignment with said pair of diametrical openings through said jacket.

24. The valve shaft assembly of claim 22, wherein said means for introducing lubricant is independent from a general lubricating system of the engine.

25. A double effect distribution sequential valve shaft assembly for controlling the intake and exhaust of gases in an internal combustion engine which includes an engine block, a cylinder formed in the engine block, the cylinder having a cylinder head, a piston slidable within the cylinder, a combustion chamber bounded by the cylinder and the piston, an intake passage in communication with the combustion chamber and an exhaust passage in communication with the combustion chamber, the valve assembly comprising:

a first hollow one-piece cylindrical jacket having a longitudinal axis, the hollow cylindrical jacket extending transverse to a passage to the combustion chamber;

said hollow cylindrical jacket being formed as a single piece including at least one pair of diametrically opposed openings through the walls of the jacket providing communication through the passage to the combustion chamber;

a first cylindrical valve shaft provided in the first hollow cylindrical jacket with a close tolerance, said first cylindrical valve shaft including a hole extending diametrically through the cylindrical valve shaft such that when the hole extending through the cylindrical valve shaft is aligned with the diametrically opposed openings through the walls of the hollow cylindrical jacket the passage to the combustion chamber is open, but when the hole extending through the cylindrical valve shaft is not aligned with the openings through the walls of the hollow cylindrical jacket the passage to the combustion chamber is closed;

a valve drive for rotating the cylindrical valve shaft at least one-fourth of a turn for every complete turn of the crankshaft; and means for generating a high pressure fluid seal between said first hollow one-piece cylindrical jacket and said first valve shaft for high closing efficiency, said fluid seal generating means comprising annular grooves formed on an internal surface of said one-piece cylindrical jacket and means for introducing a lubricant into said annular grooves to create a fluid barrier of pressure which opposes the escape of gas from the combustion chamber, said means for introducing lubricant including entry and exit ports to provide lubricant circulation through said annular groove during operation.

26. The valve assembly according to claim 25, further comprising a second hollow one-piece cylindrical jacket having a longitudinal axis, the second hollow one-piece cylindrical jacket extending transverse to a second passage to the combustion chamber;

said second hollow cylindrical jacket being formed as a single piece and including at least one pair of diametrically opposed openings through the walls of the jacket providing communication through the second passage to the combustion chamber;

a second cylindrical valve shaft provided in the second cylindrical jacket with a close tolerance, said second cylindrical valve shaft including a hole extending diametrically through the second cylindrical valve shaft such that when the hole extending through the second cylindrical valve shaft is aligned with the diametrically opposed openings through the walls of the second hollow cylindrical jacket, the second passage to the combustion chamber is open, but when the hole extending through the second cylindrical valve shaft is not aligned with the openings through the walls of the second hollow cylindrical jacket the second passage to the combustion chamber is closed;

wherein said valve drive rotates said second cylindrical valve shaft at least one fourth of a turn for every complete turn of the crankshaft; and second means for generating a high pressure fluid seal between said second hollow cylindrical jacket and said second valve shaft for high closing efficiency, said second fluid seal generating means comprising annular grooves formed on an interior surface of said second cylindrical jacket and a means for introducing a lubricant into said annular grooves to create a fluid barrier of pressure which opposes the escape of gas from the combustion chamber.

27. The valve assembly according to claim 26, wherein said first passage to the combustion chamber is the intake passage and said second passage to the combustion chamber is the exhaust passage.

28. The valve shaft assembly of claim 25, wherein said means for introducing lubricant is independent from a general lubricating system of the engine.

29. A double effect distribution sequential valve shaft assembly for controlling the intake and exhaust of gases in an internal combustion engine which includes an engine block, a cylinder formed in the engine block, the cylinder having a cylinder head, a piston slidable within the cylinder, a combustion chamber bounded by the cylinder and the piston, an intake passage in communication with the combustion chamber and an exhaust passage in communication with the combustion chamber, the valve assembly comprising:

a first hollow one-piece cylindrical jacket having a longitudinal axis, the hollow cylindrical jacket extending transverse to a passage to the combustion chamber;

said hollow cylindrical jacket being formed as a single piece including at least one pair of diametrically opposed openings through the walls of the jacket providing communication through the passage to the combustion chamber;

a first cylindrical valve shaft provided in the first hollow cylindrical jacket with a close tolerance, said first cylindrical valve shaft including a hole extending diametrically through the cylindrical valve shaft such that when the hole extending through the cylindrical valve shaft is aligned with the diametrically opposed openings through the walls of the hollow cylindrical jacket the passage to the combustion chamber is open, but when the hole extending through the cylindrical valve shaft is not aligned with the openings through the walls of the hollow cylindrical jacket the passage to the combustion chamber is closed;

a valve drive for rotating the cylindrical valve shaft at least one-fourth of a turn for every complete turn of the crankshaft;

means for generating a high pressure fluid seal between said first hollow one-piece cylindrical jacket and said first valve shaft for high closing efficiency, said fluid seal generating means comprising annular grooves formed on an internal surface of said one-piece cylindrical jacket and means for introducing a lubricant into said annular grooves to create a fluid barrier of pressure which opposes the escape of gas from the combustion chamber;

a second hollow one-piece cylindrical jacket having a longitudinal axis, the second hollow one-piece cylindrical jacket extending transverse to a second passage to the combustion chamber;

said second hollow cylindrical jacket being formed as a single piece and including at least one pair of diametrically opposed openings through the walls of the jacket providing communication through the second passage to the combustion chamber;

a second cylindrical valve shaft provided in the second cylindrical jacket with a close tolerance, said second cylindrical valve shaft including a hole extending diametrically through the second cylindrical valve shaft such that when the hole extending through the second cylindrical valve shaft is aligned with the diametrically opposed openings through the walls of the second hollow cylindrical jacket, the second passage to the combustion chamber is open, but when the hole extending through the second cylindrical valve shaft is not aligned with the openings through the walls of the second hollow cylindrical jacket the second passage to the combustion chamber is closed;

said valve drive rotating said second cylindrical valve shaft at least one-fourth of a turn for every complete turn of the crankshaft;

second means for generating a high pressure fluid seal between said second hollow cylindrical jacket and said second valve shaft for high closing efficiency, said second fluid seal generating means comprising annular grooves formed on an interior surface of said second cylindrical jacket and a means for introducing a lubricant into said annular grooves to create a fluid barrier of pressure which opposes the escape of gas from the combustion chamber;

said first passage to the combustion chamber being the intake passage and said second passage to the combustion chamber being the exhaust passage;

said means for introducing lubricant including entry and exit ports to provide lubricant circulation through said annular groove during operation.

30. The valve shaft assembly of claim 29, wherein said exit port has a smaller diameter than said entry port.

31. The valve shaft assembly of claim 29, wherein said means for introducing lubricant is independent from a general lubricating system of the engine.

* * * * *